US006925930B1

(12) United States Patent
Zimmer

(10) Patent No.: US 6,925,930 B1
(45) Date of Patent: Aug. 9, 2005

(54) COMPACTOR/BAILER COMBINATION

(76) Inventor: John C. Zimmer, 2419 Bayou Bend, New Iberia, LA (US) 70119

( * ) Notice: Subject to any disclaimer, the term of this patent is extended or adjusted under 35 U.S.C. 154(b) by 0 days.

(21) Appl. No.: 10/638,863

(22) Filed: Aug. 11, 2003

(51) Int. Cl.[7] ..... B30B 1/00
(52) U.S. Cl. ..... 100/215; 100/218; 100/225; 100/226; 100/229 A
(58) Field of Search ..... 100/3, 45, 48, 100/49, 52, 221–226, 232, 229 A, 252, 255, 100/218, 215

(56) References Cited

U.S. PATENT DOCUMENTS 3,687,068 A * 8/1972 Loughran ..... 100/255
3,808,967 A * 5/1974 Fair et al. ..... 100/221
3,863,561 A * 2/1975 Karls ..... 100/352
3,910,181 A * 10/1975 Andrews et al. ..... 100/226
4,002,115 A * 1/1977 Nanoia ..... 100/343
4,232,599 A * 11/1980 Ulrich ..... 100/25
4,777,873 A 10/1988 Zimmer
5,255,982 A 10/1993 Zimmer
5,361,692 A 11/1994 Zimmer
5,746,121 A 5/1998 Zimmer

* cited by examiner

*Primary Examiner*—Derris H. Banks
*Assistant Examiner*—Jimmy T Nguyen
(74) *Attorney, Agent, or Firm*—Jones, Walker, Waechter, Poitevent, Carrere & Denegre, L.L.P.

(57) ABSTRACT

The device is a combination bailer/compactor that is a structure with a series of sidewalls and a floor portion, the structure having a top portion and a bottom portion. The sidewalls form an interior, where the interior is further subdivided into a bailer compartment and a compactor compartment by a common interior partition. Each interior compartment has a separate access opening and access door closing the opening. A track is located near the top portion with a compressive ram being mounted in a frame which is moveable in the track between the bailer compartment and the compactor compartment. A power source is operationally connected to the compressive ram. Both compartments are equipped with access doors.

13 Claims, 19 Drawing Sheets

COMPACTOR/BAILER COMBINATION

BACKGROUND OF THE INVENTION

1. Field of Invention

This invention relates to space saving trash compactors and bailers, and in particular to a compactor/bailer combination sharing a common ram.

2. Prior Art

In the offshore environment, environmental concerns have lead to efforts to recycle materials instead of land filling. However, an additional driving concern in the offshore environment is the efficient utilization of space. Space is at a premium in this environment, and equipment is designed to conserve space yet still efficiently perform the task. For these reasons, space efficient compaction systems have become prevalent offshore. One such system is disclosed in U.S. Pat. No. 5,746,121 to Zimmer, hereby incorporated by reference. As disclosed, this design utilizes a ram which is moveable both vertically to compress as well as horizontally to allow access to the crushed materials. The ram is horizontally movable on tracks which extend outwardly from the upper edge of the compactor container.

A particular type of recyclable material prevalent in the offshore environment is cardboard boxes and similar paper type storage containers and packaging products. For recycling purposes, it is more efficient to separate such cardboard materials from other materials at the offshore location of use, rather than shipping unseparated materials for later processing. Bailing cardboard materials at the offshore location also keeps such materials secure from being blown off location by wind or other environmental factors. Cardboard packaging materials are usually compressed and wrapped for storage for later disposal or recycling in a bailer, such as shown in U.S. Pat. No. 4,777,873 to Zimmer, hereby incorporated by reference. Both a compactor and bailer are desired equipment, however, both take up valuable space. It is desired to utilize both in a space saving configuration.

OBJECTS OF THE INVENTION

It is an object of the invention to provide an apparatus containing a bailer and compactor.

It is an object of the invention to provide an apparatus containing a bailer and compactor utilizing a common ram.

It is an object of the invention to provide an apparatus containing a bailer and compactor which efficiently utilizes space.

It is an object of the invention to provide an apparatus containing a bailer and compactor which minimizes pinch points.

SUMMARY OF THE INVENTION

The invention is a structure with two adjacent compartments with—a bailer compartment and a compactor compartment. Each compartment has an access opening, and the two access openings are located on adjacent sidewalls of the structure. Positioned near the top of the structure is a track with a ram moveable on the track to be positioned for vertical ramming through the open tops in each of the two compartments.

DETAILED DESCRIPTION OF THE PREFERRED EMBODIMENT

Figure 1:
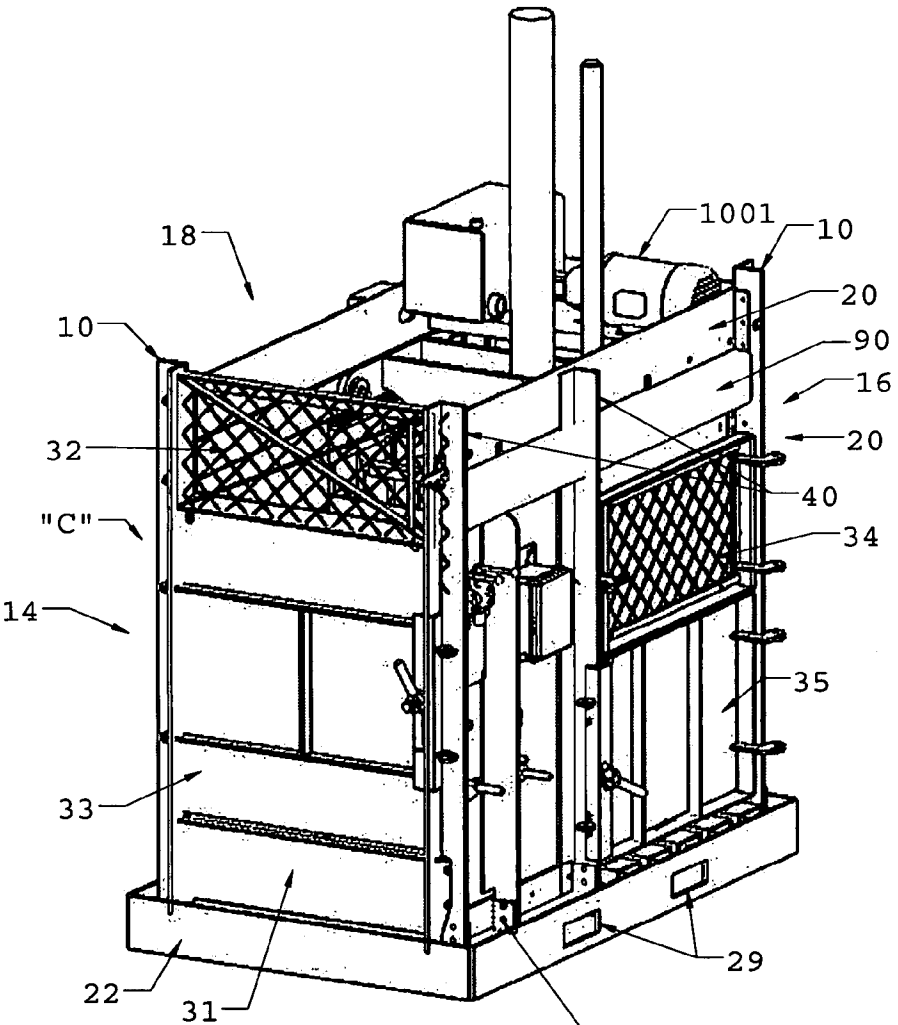
FIG. 1 is a prospective view of the preferred embodiment of the present invention.

As seen in FIG. 1, the device comprises a structure 12 with side walls 14, 16, 18, 20, a base or floor portion 22 and an open top 24. Side walls 14, 16, 18 and 20 are removably attached to the floor portion 22 to allow the device to be disassembled for ease of transportation. Much of the structure and floor is constructed of ¼ or ¾ inch steel plate. As shown, the side walls are bolted to the floor portion 22 at various locations. To assist in attaching, bolt flanges 22A are to be provided on the floor 22. Sidewalls may be joined to adjacent sidewalls though re-inforced corner pieces 10. Vertical ribs 40 located on the sides may provide suitable bolt flanges to assist joining the sides to the bottom. Additionally, the vertical ribs stiffen to the structure 12 to help resist racking in use. Also shown are slots 29 positioned on the sides of the floor to provided attachment points for shackles or hooks for attaching to a crane or other lifting device. In this fashion, the assembled device is readily moveable. Shown on sidewall 20 are controls 43 used to operate and control the motors and pumps on the device.

Figure 6A:
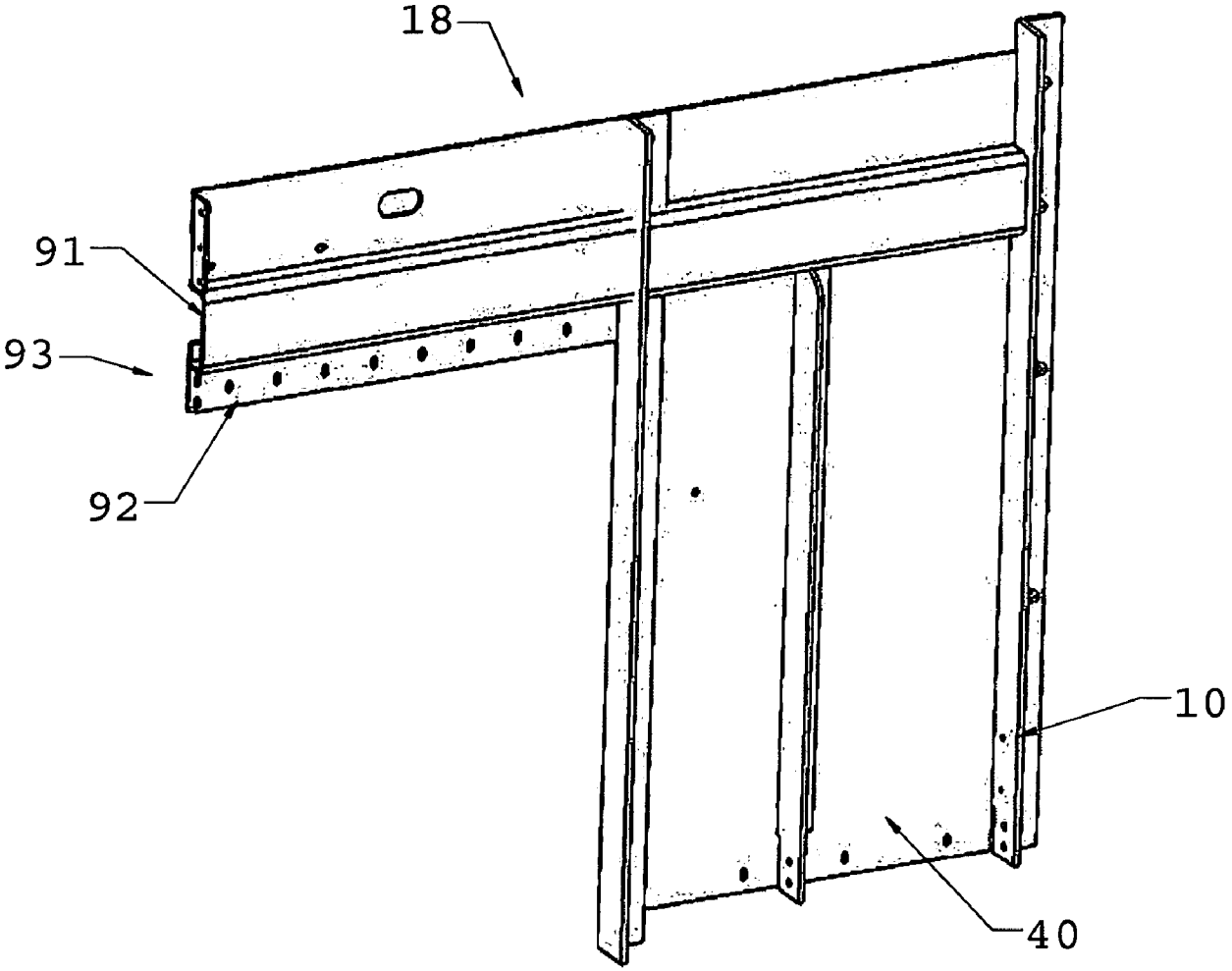
FIG. 6A is a prospective view of a one side of the preferred embodiment of the present invention.
Figure 6B:
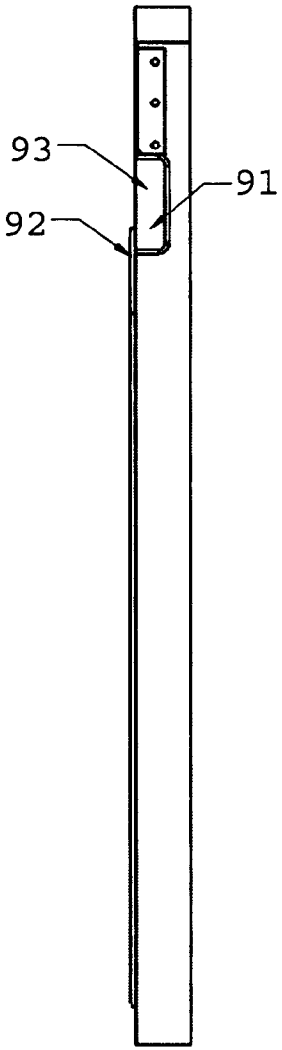
FIG. 6B is a side view of the side of FIG. 6A showing details of the channel.
Figure 7:
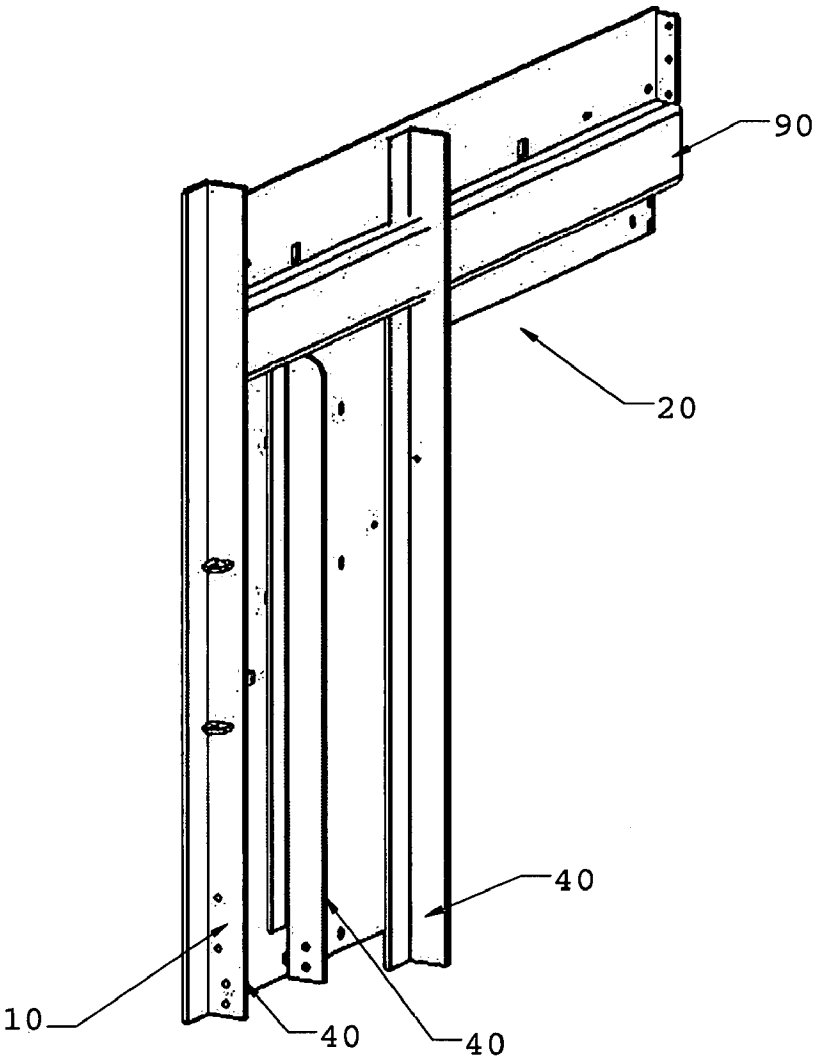
FIG. 7 is a prospective view of a second side of the preferred embodiment of the present invention.

Located near the top of sidewalls 18 and 20, respectively, are protruding horizontal guide channels 90 and 91, best seen in FIGS. 6, 6B and 7. Horizontal guide channels 90 and 91 are rectangular "C" shaped outwardly protruding channels that open to the interior of the frame. Located on the interior of the guide channel is upstanding lip 92 which partially closes the interior of the channel. The two guide channels 90 and 91 with lip 92 forms a guide track 93 on the structure to accommodate and guide the movement of the hydraulic frame 44. The guide channels are formed as outwardly directed channels; they could also be formed as inwardly directed channels.

Figure 10:
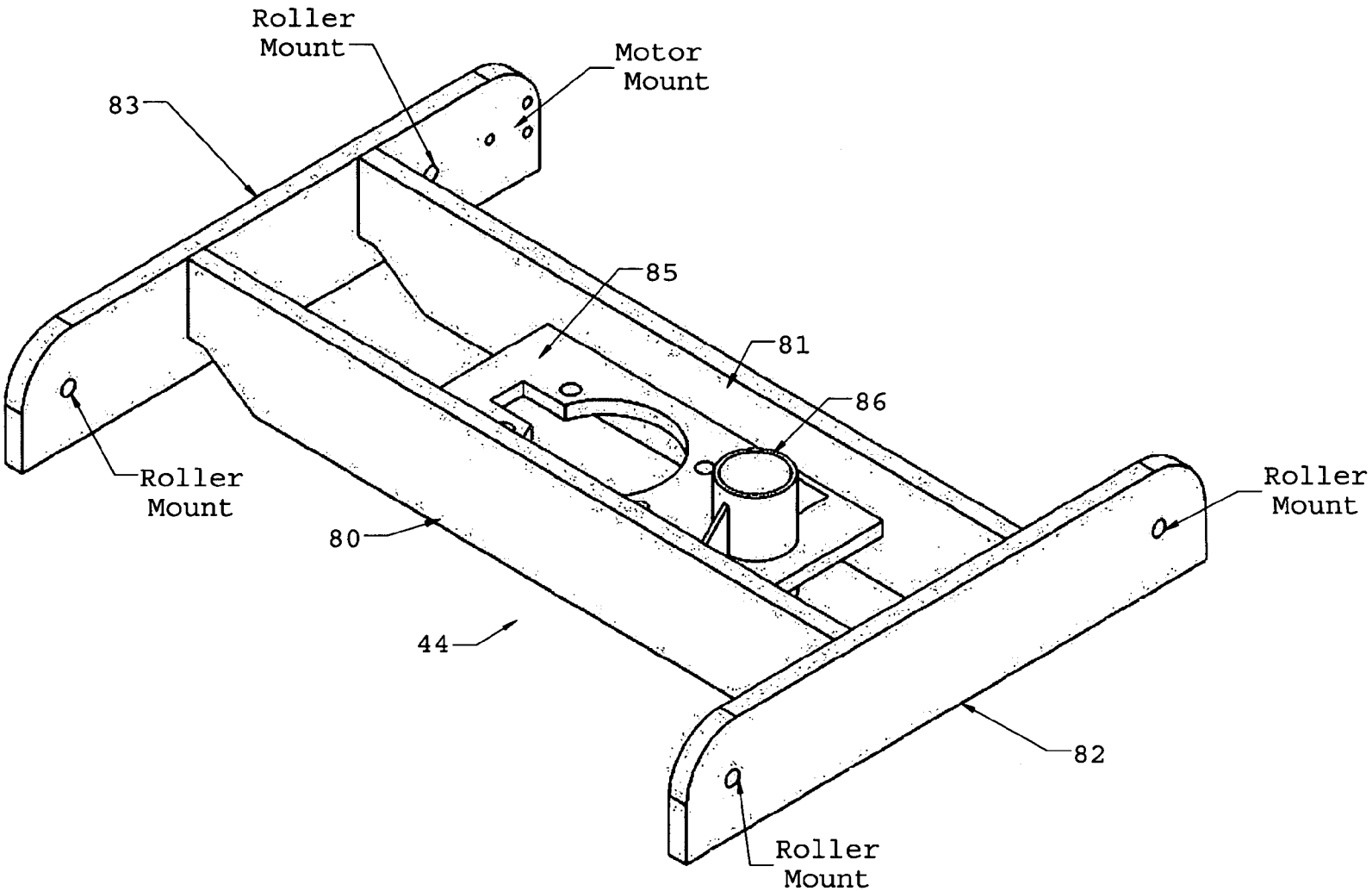
FIG. 10 is a prospective view of the hydraulic frame.
Figure 10A:
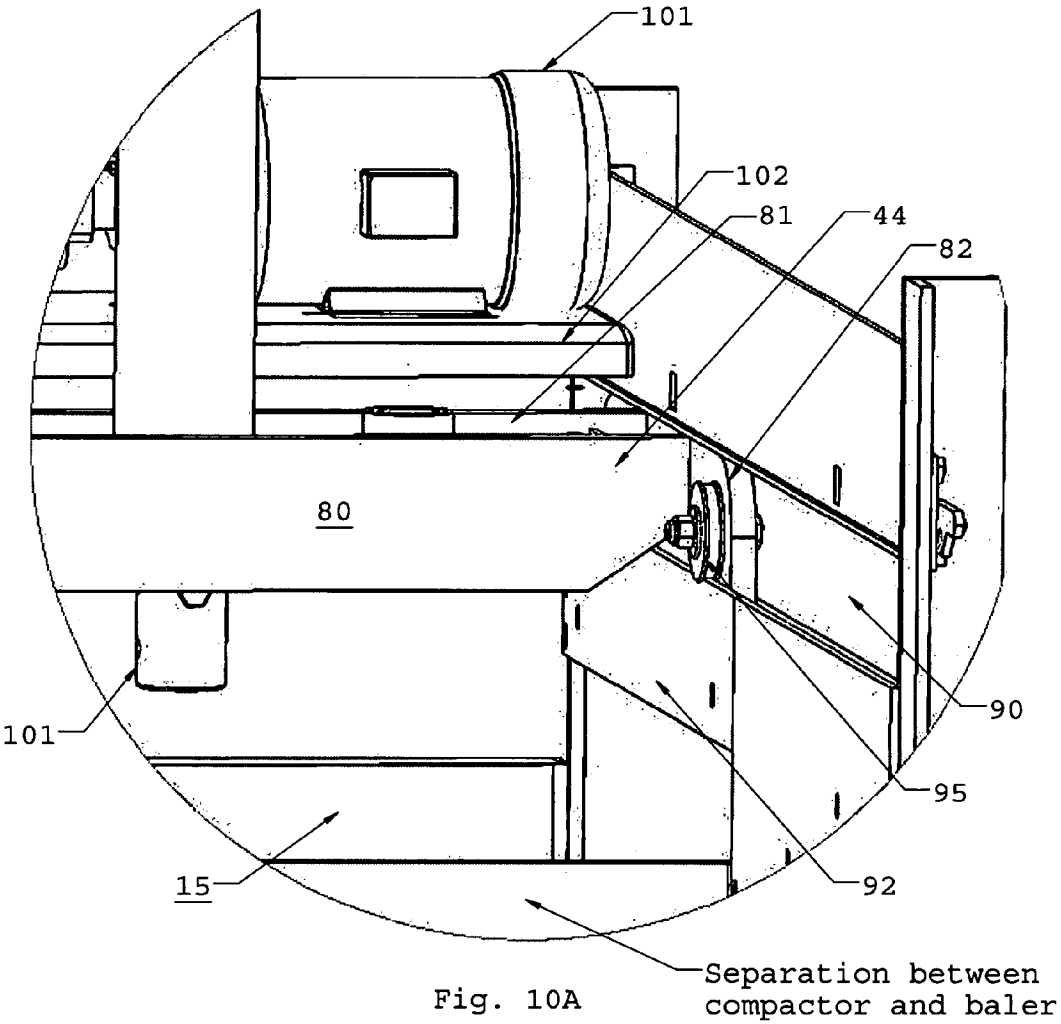
FIG. 10A is a prospective view of top interior of the structure showing the hydraulic frame's relationship to the guide channel.
Figure 10B:
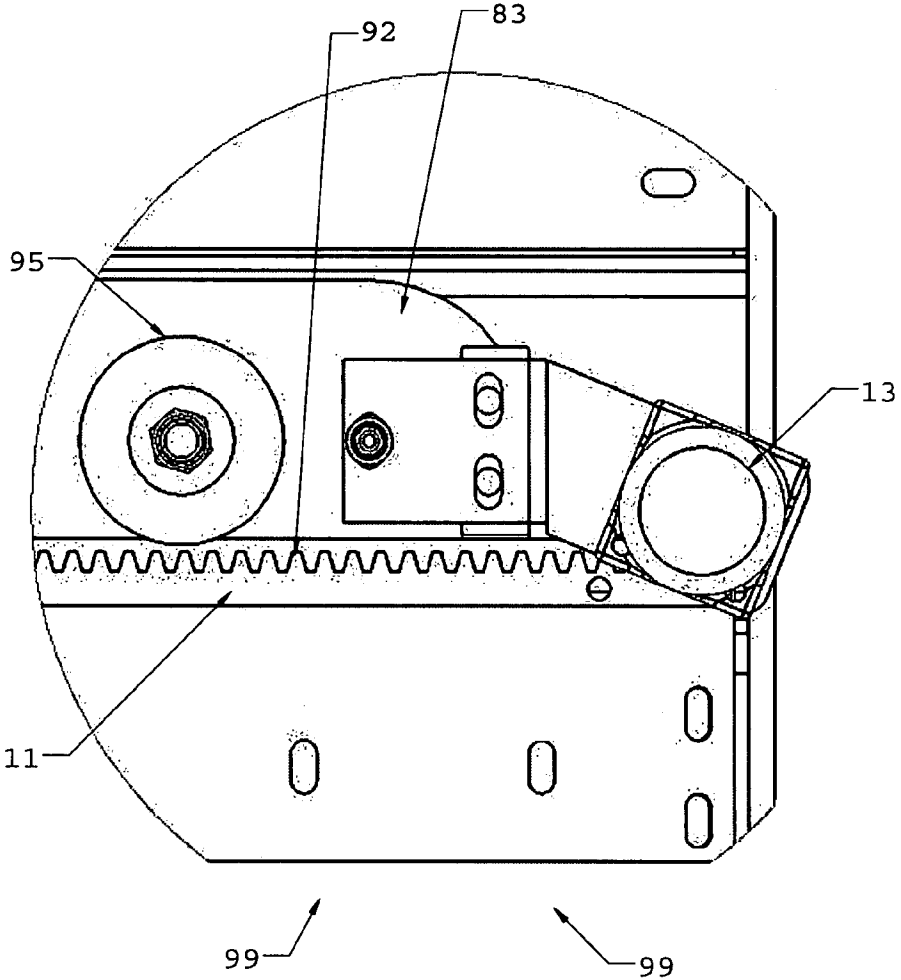
FIG. 10B is a prospective view of a portion of the track showing the gear rack and motor.
Figure 11:
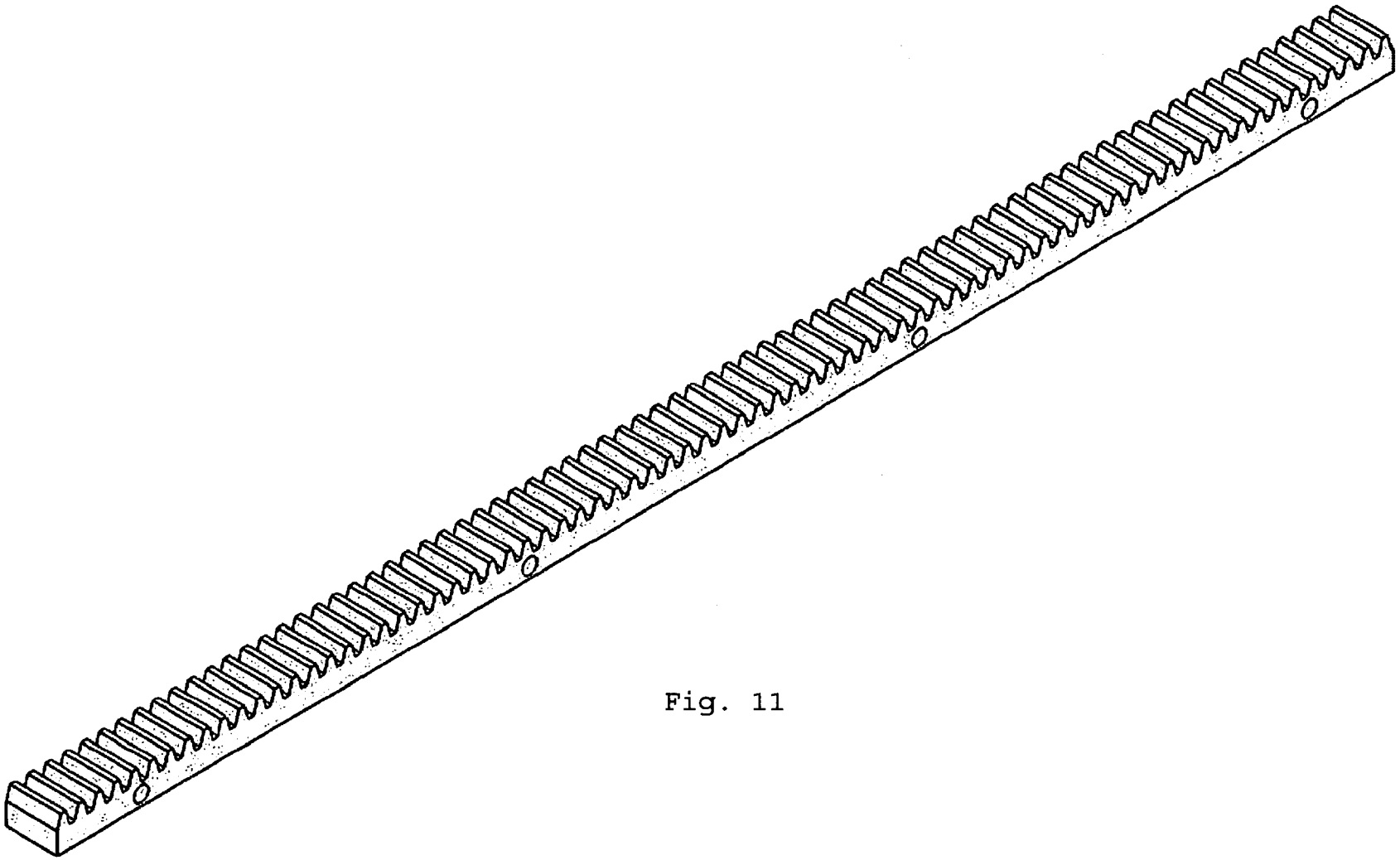
FIG. 11 is a prospective view of the gear rack.

As seen in FIG. 10, hydraulic frame 44 has four steel plates, two support plates 80 and 81 and two slide plates 82 and 83, assembled in a box-like configuration. The two support plates 80 and 81 extend between sidewalls 18 and 20 and the two slide plates 82 and 83 are positioned on the ends of the support plates 80 and 81 in a right angle relationship. The two slide plates 82 and 83 are slidably positioned in the interior of the guide channels 91 and 90 behind the upstanding lip 92, as shown in FIG. 10A. Rotatably mounted on the interior ends of each slide plate 82 and 83 are rollers 95 which ride on the top of upstanding lip 92 on guide channels 90 and 91. Hence the hydraulic frame 44 is slidable across the top of the structure, and movement of the hydraulic frame 44 is assisted by operation of a motor 13 mounted on one of the slide plates (see FIG. 10B). The motor's gears intermesh with a gear rack 11 positioned on the upstanding lip 92 of one of the horizontal channels. The motor utilized is a small hydraulic device.

When installed, the hydraulic frame 44 is trapped between the two sidewalls 18 and 20 behind the upstanding lip 92 and ties these two sidewalls together. In operation, the forces exerted by the compactor or bailer will tend to cause the sidewalls to "bow out," which movement is resisted by the hydraulic frame 44. The hydraulic frame 44 and guide channels with upstanding lip 92 cooperate to create a means for resisting sidewall bow out, and hence maintains the structural integrity of the device during use.

Figure 8A:
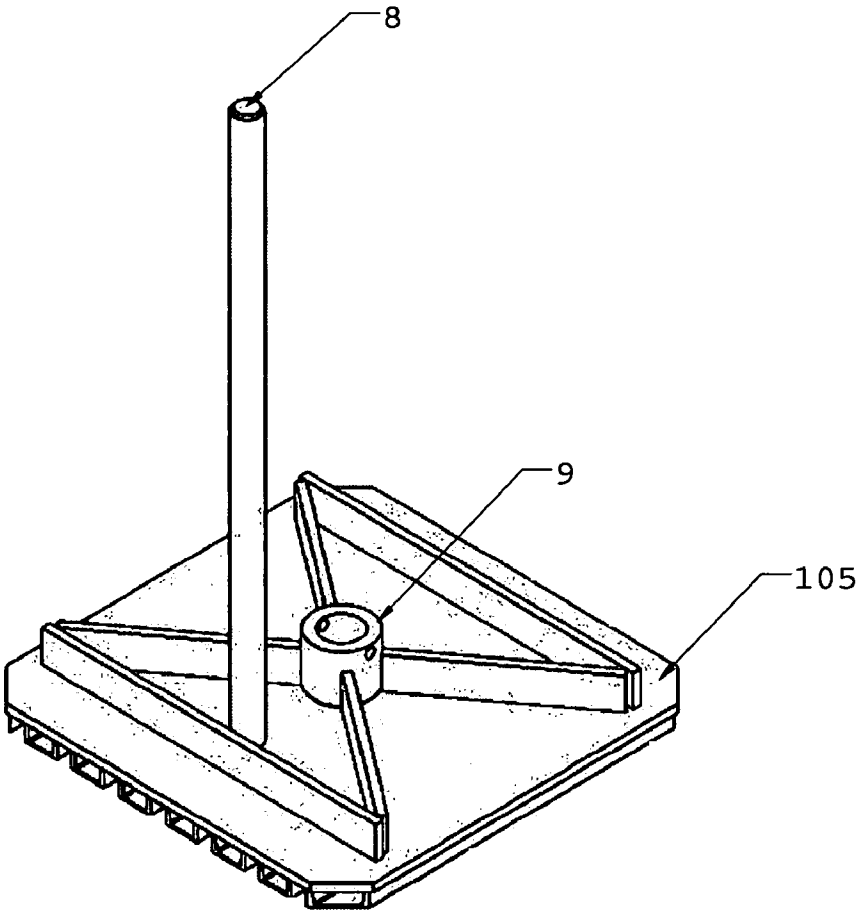
FIG. 8A is a top prospective view of the ram.
Figure 8B:
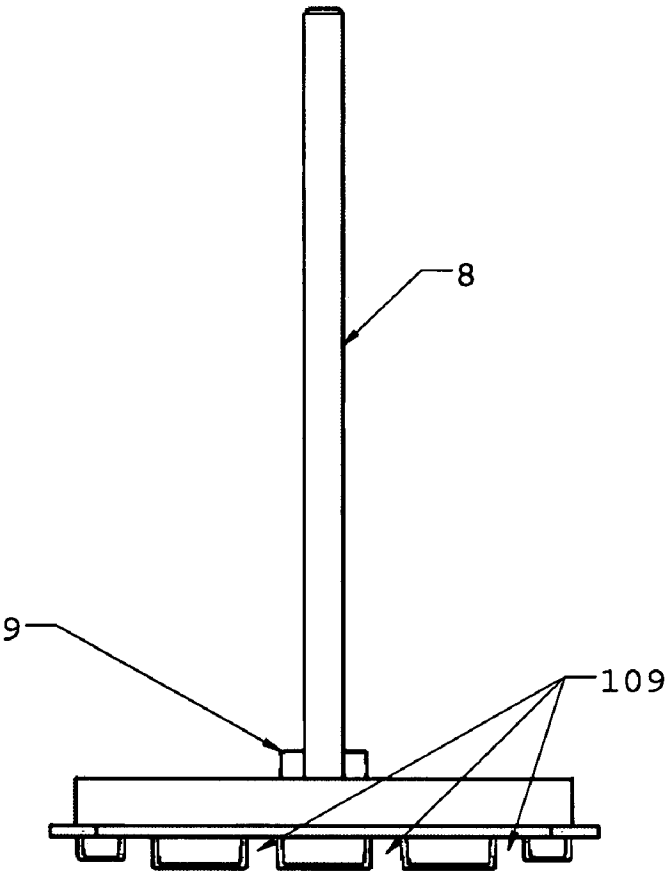
FIG. 8B is a side prospective view of the ram.

Positioned between the two support frames 80 and 81 is a carrying plate 85 having a guide sleeve 86 for guiding the hydraulic ram 105 supported by the carrying plate. Hydraulic ram 105 includes ramming plate 106 (positioned below the carrying plate 85), guide rod 8 and piston collar 9. As shown, the underside of the ramming plate 106 (the contact side) has a series of parallel slots 109 running from one side of the plate to the opposing side (see FIGS. 8A and 8B). The slots are orientated to run between sidewalls 18 and 20, for purposes later described. The top non-contact surface of the ramming plate 106 has cross bracing to stiffen the ramming plate. The carrying plate 85 also has an opening 87 there through to accommodate the hydraulic piston 101 and cylinder 102 carried on the carrying plate that drives the hydraulic ram 105. Guide rod 8 slides in guide sleeve 86 on the carrying plate 85 and helps maintain the ramming plate 106 in the proper position and orientation during operation. The hydraulic piston/cylinder 101/102 operates to move the ramming plate 106 between a fully retracted non-operating (not compressing) position and an extended operational (compressing) position. The piston/cylinder and ramming plate comprise a means for compressing materials.

Positioned below the track 93 is a vertically orientated interior partition or sidewall 15 located between sidewalls 18 and 20. Interior partition 15 divides the interior of the structure into two adjacent compartments, a bailer compartment B and a compactor compartment C. Each interior compartment could be formed with separate interior partitions, instead of a common interior partition, however, a single interior partition is favored, as such reduces the weight of the structure. The interior partition 15 is extends from the floor 22 to a height sufficiently below the guide channels 93 to allow the ramming plate 106, when retracted, to clear the partition 15 when the hydraulic frame 44 is slid from one compartment to the other compartment. The carrying plate 85, and hence the ramming plate 106, is positionable above the bailer compartment B and the compactor compartment B to perform crushing operations.

Safety features are provided on the device to prevent the hydraulic ram from operating unless properly positioned within either the bailer compartment B or compactor compartment C. Two limit switches (not shown) are positioned on or near the guide tracks 93 which, when tripped, allow the hydraulic cylinder 102 to operate. The limit switches are tripped by the hydraulic frame 44 when moved into the proper position either centered above the compactor compartment C or above the bailer compartment B. Additionally, another limit switch can be provided to prevent the hydraulic frame 44 from moving when the hydraulic piston 101 is extended, that is, when the device is operating.

Also located on the device is motor plate 999, shown located above the bailer compartment B, connecting sidewalls 18, 16 and 20. Motor plate 999 is positioned above the guide channels, and the hydraulic frame 44 partially slides underneath the motor plate when the hydraulic frame 44 is centered in the bailer compartment B. Motor plate 999 provides space for the placement of the hydraulic reservoir 1000 and the pump 1001 which drives the hydraulic devices of the system. Details of the interior of the compartments and sidewalls follow.

Sidewall 16 is solid wall that may include reinforcing fins. Sidewalls 20 and 18 are essentially mirror images of each other, with opening to accommodate features of the bailer (see FIGS. 6A and 7). Both sidewalls 20 and 18 are "L" shaped. Sidewall 20 has an cutout to accommodate an access door into the bailer compartment B, while sidewall 18 has an cutout to accommodate slats 99. Slats 99 are metal plates (see FIG. 12A showing the center slat) that extend between the floor of the device and the sidewall 18. As shown, the device accommodates 5 slats. The slats 99 are positioned to be non-abutting, thereby creating a grid of vertically orientated access slots in the lower rear of the bailer compartment B. (see FIG. 12).

Figure 12:
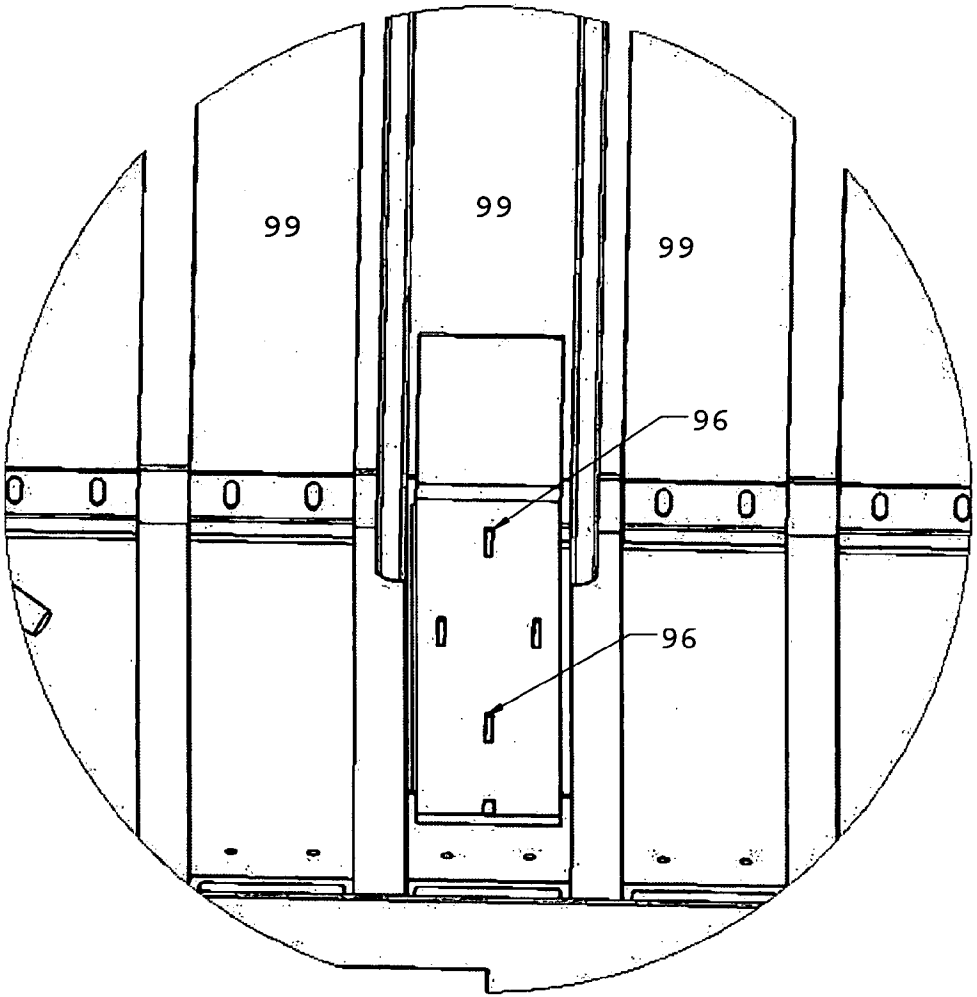
FIG. 12 is a prospective view of the hydraulic frame.
Figure 12A:
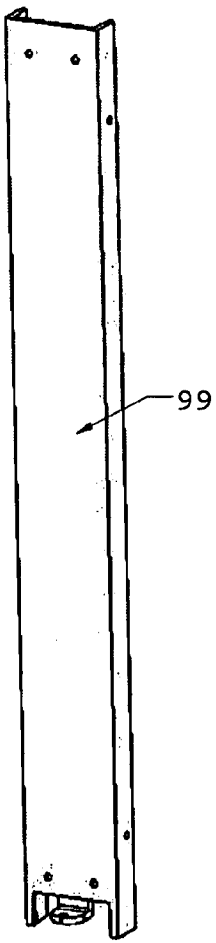
FIG. 12A is a prospective view of the center slat.

The floor of the bailer compartment B has a series of raised platforms 97 (as shown in FIG. 12, there are 5 raises platforms). The volume between adjacent platforms 97 forms a floor slot, and the bailer floor slots align with the slots in the bailer sidewall (see FIG. 12). The slots in the sidewalls are also placed to align with the slots in the bottom of the ramming plate 106. That is, the slots in the ramming plate 106 should be parallel with the floor slots, i.e. the ramming plate slots run from the edge for the plate that faces the opening in the bailer compartment B to the edge of the ramming plate that faces the rear or back wall of the bailer compartment B. This series of aligned slots (sidewall slots, ramming plate slots and floor slots) are used to assist in bailing materials compressed in the bailing chamber (primarily cardboard materials) as later described. For reference purposes, the slotted area on sidewall 18 forms the "back" of the bailer chamber, while the open area on sidewall 20 or the access opening forms the "front" of the bailer compartment B.

Figure 2:
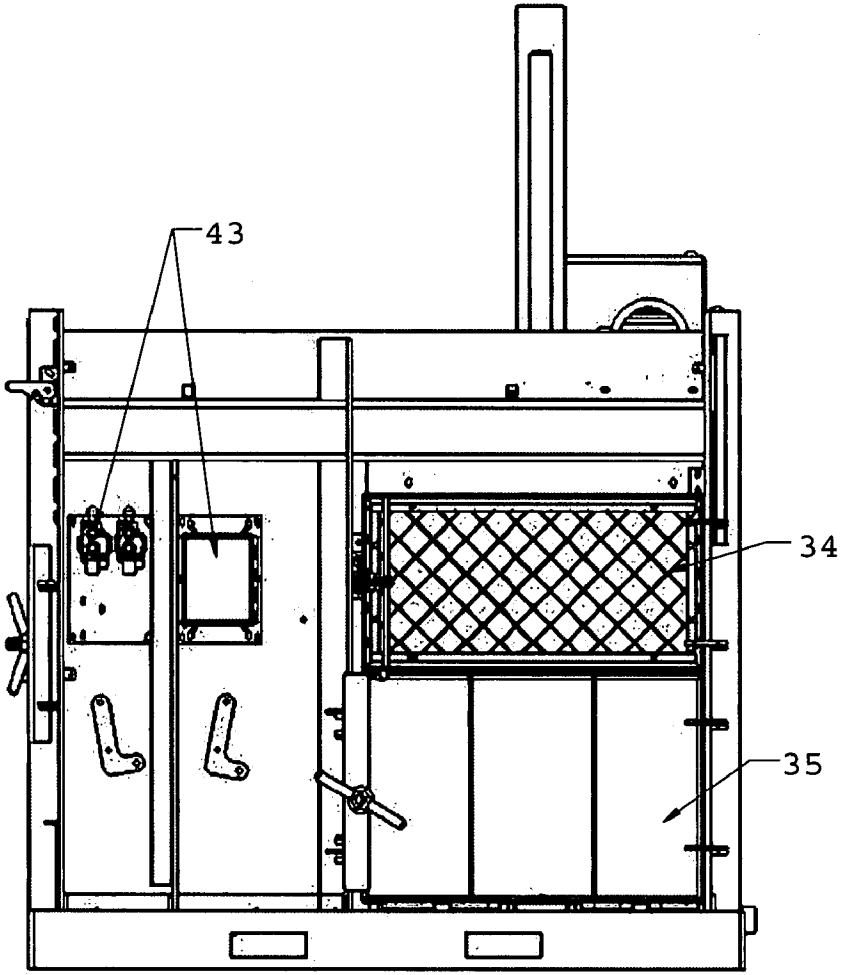
FIG. 2 is a side view of the preferred embodiment of the present invention.
Figure 3:
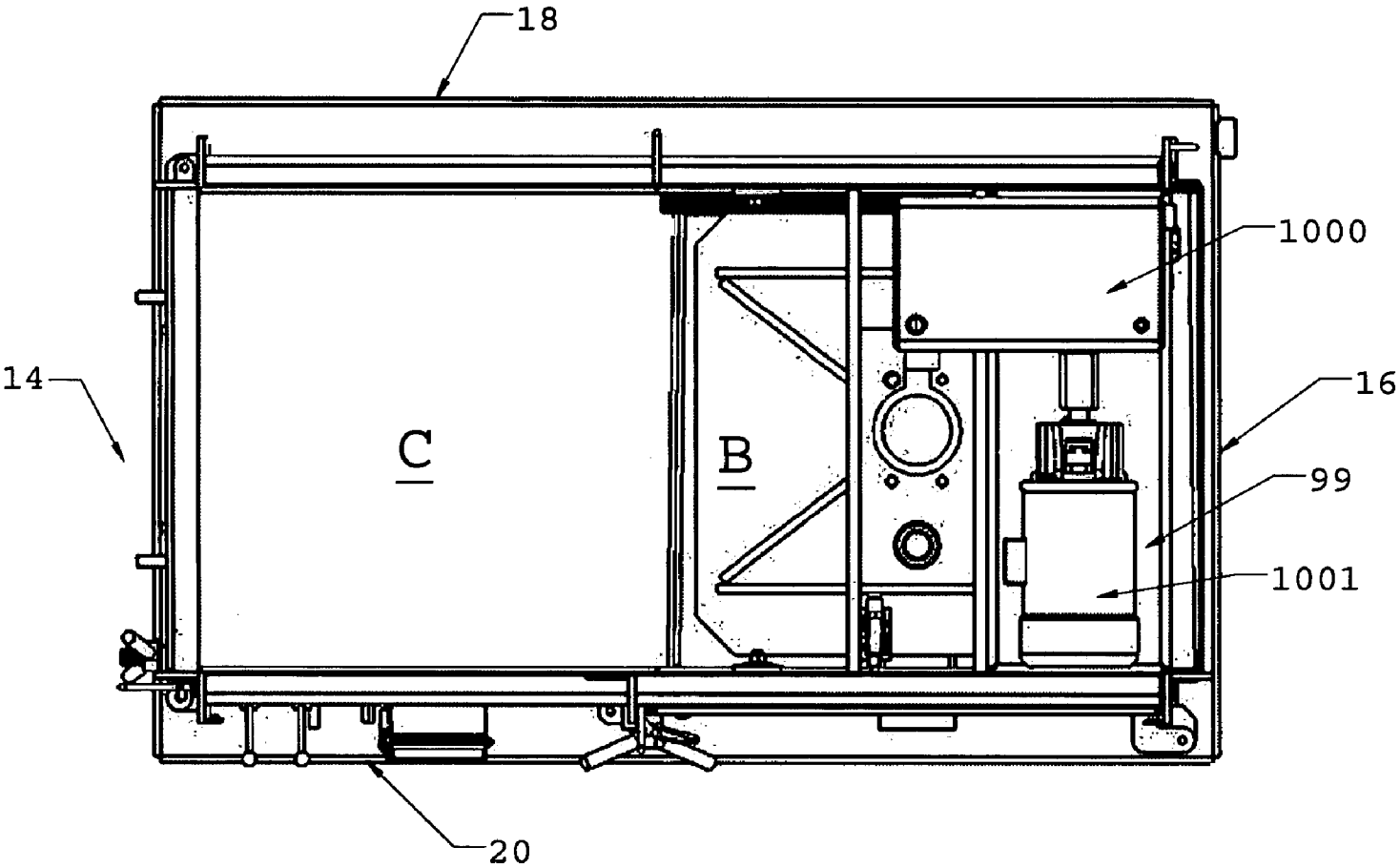
FIG. 3 is a top view of the preferred embodiment of the present invention.
Figure 4:
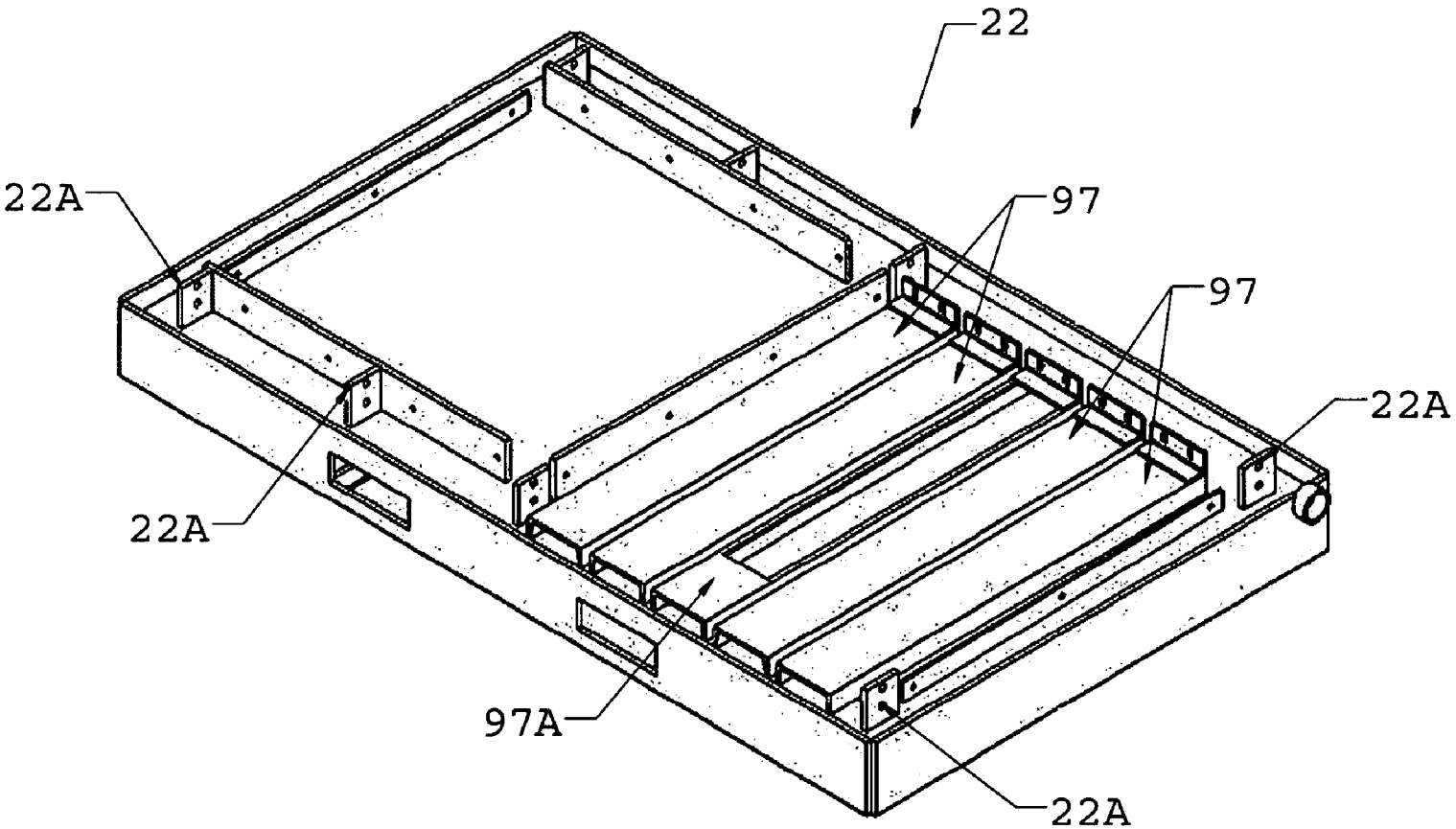
FIG. 4 is a prospective view of the base or floor section of the invention.
Figure 5:
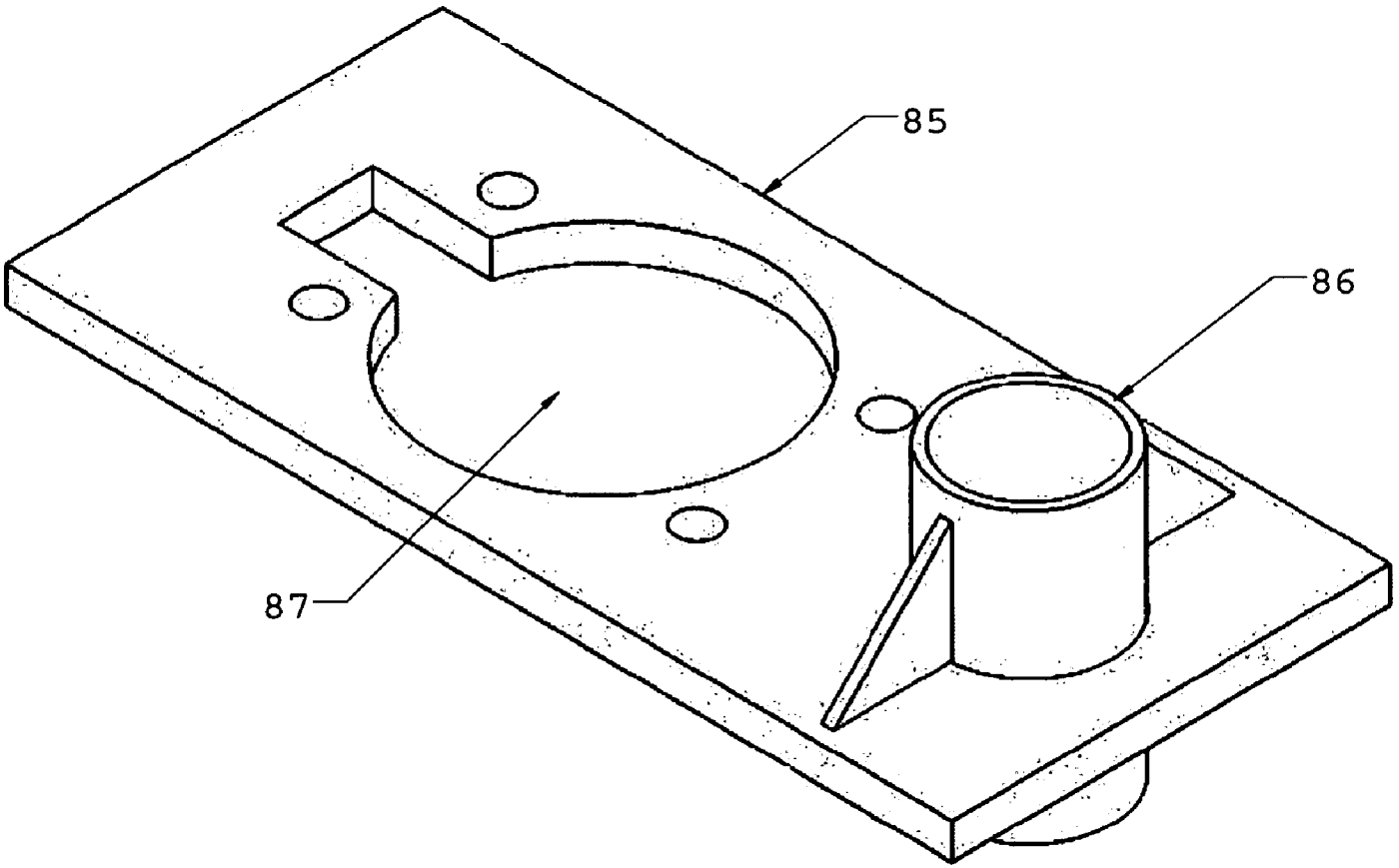
FIG. 5 is a prospective view of the cylinder mount.

The front of the bailer compartment B has a solid bottom access door 35 occupying about ½ of the height of the opening in the sidewall 18 above the floor portion, and a top screened access door 24, occupying the top ½ of the opening in the sidewall 18. The two doors are independent of each other, and both are latchable, as is shown in FIG. 1 and FIG. 2. The top screened access door 24 is utilized to load the compartment with materials without having to open the bottom access door 35. Additionally, safety switches can be installed so that power cannot be provided to the ram cylinder unless the doors are closed, or closed and latched.

Another feature of the bailer compartment B is the shape of the compartment. It may be desirable to have the interior compartment tapered toward the front (that is, wider in the rear than the front). Such a taper can assist in removing materials from the chamber.

The bailing chamber may contain a bailed material removal means to assist removal of the bailed material. One such removal means is shown in U.S. Pat. No. 4,777,873 to Zimmer, herein incorporated by reference. A second removal means includes a removable slidable top panel 97A positioned on at least one of the floor raised platforms 97, and a series of teeth 96 positioned on the slidable top panel. As shown in FIG. 12, one embodiment includes a slidable top panel 97A positioned on the center raised floor platform. In this instance, the interior of the center raised platform forms a hollow. Positioned in the hollow and forming part of the removal means is a hydraulically operated cylinder, which is connected to the underside of the slidable top panel 97A. The cylinder has a "throw" or range of extent of about 12 inches. When operated, the cylinder cycles, extending and retracting and consequently, results in the top panel sliding forward, then sliding rearward, and then repeating the cycle.

Another removal means includes a hydraulically driven screw drive positioned the hollow of at least one of the raised platforms 97 in the bailer compartment B. These raised platforms would also have a panel slidable on the top of the raised platform with a gear surface (such as a gear rack) positioned on the underside of the top slidable panel. The gear surface would intermesh with the screw drive thereby allowing the slidable panels to be moved forward and rearward by operation of the screw drive. The rear of these top panel may have an "L" shape or have a raised lip. Upon activation of the motor, the screw drive turns, sliding the top panel outward, along with the bailed materials which would catch on the raised lip. When the removal operation is complete, the screw drive would reverse, re-positioning the panel top within the bailer compartment B.

Figure 9A:
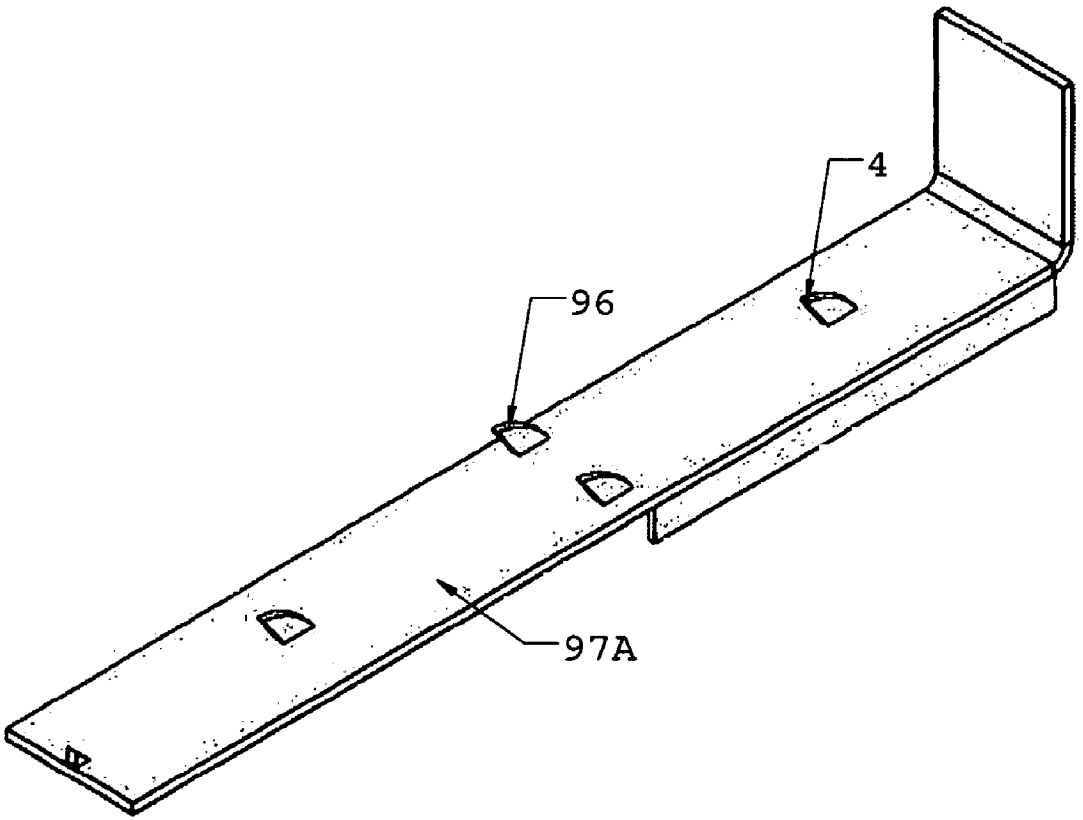
FIG. 9A is a prospective view of the center raised panel of the bailer floor.
Figure 9B:
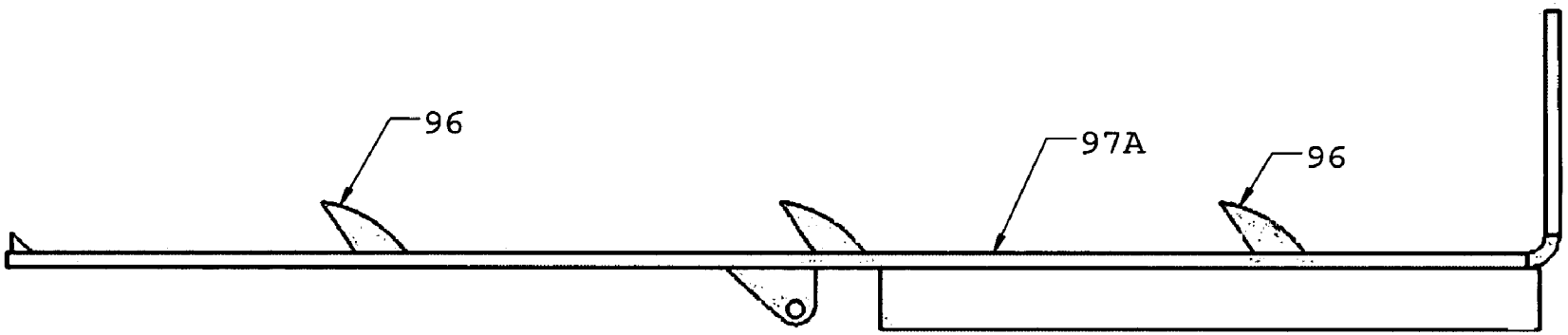
FIG. 9B is a side view of the center raised panel of the bailer floor.

The removal means may include a series of upstanding forward facing teeth 96 positioned on the raised platforms of the floor. The teeth 96 are designed with protrusions facing the front of the bailer chamber to "catch" materials located on the floor to assist in sliding the materials out of the chamber, but resist sliding of materials into the chamber (see FIG. 9B).

The remaining sidewall of the structure forms the front of the compactor compartment C, and consists essentially of two access doors into the compactor compartment C and a fixed bottom panel 31 (about 12 inches in height) joining sidewalls 18 and 20. The two access doors include a bottom solid door 33 and a top screened door 32. See FIG. 1. Both doors are latchable to the joining sidewalls of the structure and when the bottom access door 33 is latched, a rigid frame is created capable of resisting the outward expansive forces that result from compression of materials in the compartment by operation of the ram.

As can be seen in FIG. 1, the sidewall containing the access opening for the compactor compartment C and the sidewall containing the access opening for the bailer compartment B are adjacent sidewalls, with the access door for the compacter compartment located on a sidewall lacking guide channels 90. This configuration allows access to the rear of the bailer compartment and also allows the controls for the device to be placed intermediary to both access doors where operation of the ram (in either compartment) can be observed while operating the controls. It is possible for both openings to be on the same sidewall, but such a configuration is not preferred as this arrangement reduces the available space for the compactor compartment C. In a single wall opening configuration, all access doors (for both compartments) would have to be located below the protruding guide channels 90. Further, such an arrangement makes it more difficult to remove materials from the compactor chamber C by crane, the preferred method of in the offshore environment. With the compactor access opening on the same wall as the bailer access opening, a crane would have to lift the bagged crushed materials up over the side wall of the device, an unnecessary risk. However, in the configuration of FIG. 1, a crane can drag the bagged crushed materials out the front of the opening, without the need to lift the bag above the walls of the container. For the same reason, it is not preferred to have the two access openings located on the opposing sidewalls which are not parallel to the interior partition (as shown, longer sidewalls 18 and 20). One configuration which is usually non-functional is where the access openings are located on the opposing sidewalls which sidewalls are parallel to the interior partition (as shown, sidewalls 14 and 16). This configuration does not provided access to the rear of the bailer chamber B needed for bailing operations later described.

Figure 13:
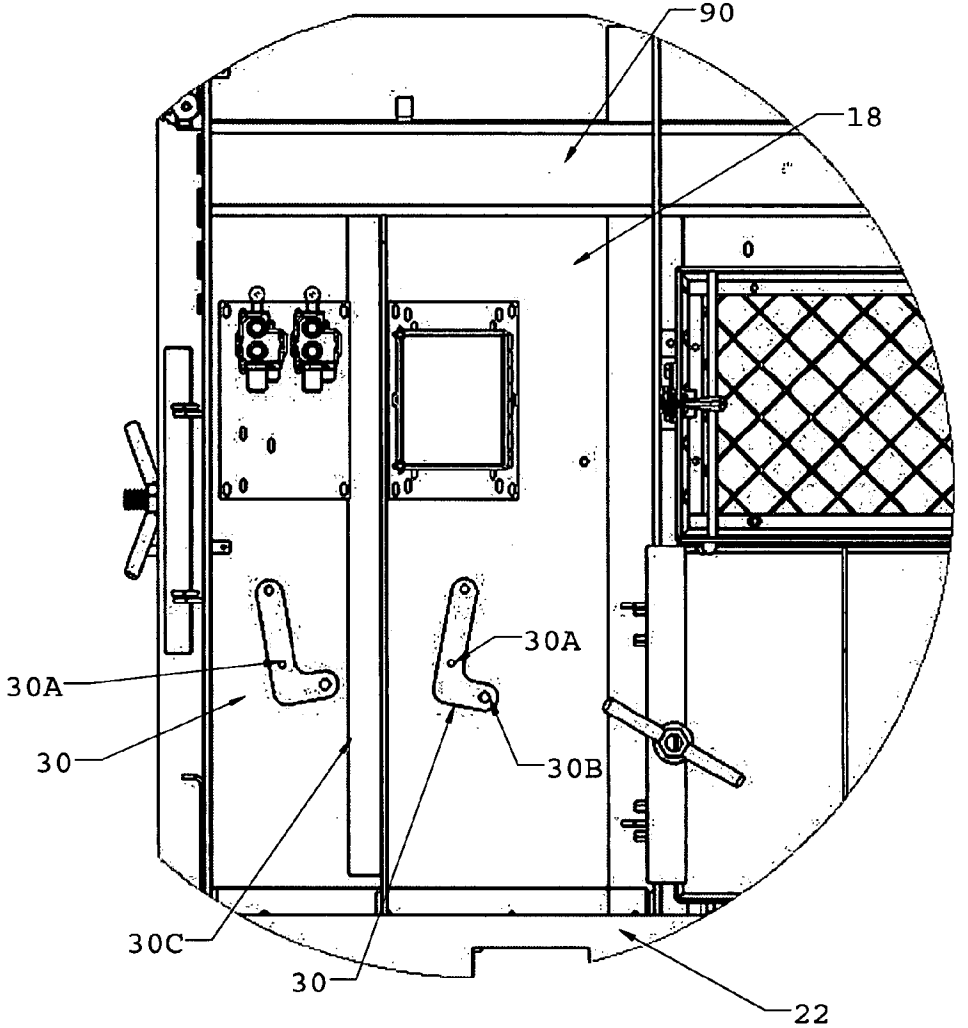
FIG. 13 is a side view of one sidewall showing details of the pivoting arms.

In operation of the compactor, a tear resistant plastic bag (or other storage device) can be placed in the interior of the compaction compartment. To maintain the bag in an open presentation, the bags are attached to the sidewalls 18 and 20 through generally four webbing loops sewn to the "corners" of the bag (see FIG. 13). Slots are provided in the sidewalls near the front and back of rear of the compactor compartment to thread the webbing from the interior of the compartment to the exterior sidewalls. The front slots can be cut in the bottom access door, or the webbing can be threaded through the slot between the first access and second screen access door (See FIG. 13, showing the front webbing threaded through the structure). The webbing is attached to the sidewalls for support, such as by looping the webbing over pins located on the sidewalls.

Shown in FIG. 13 are details of one embodiment of the webbing attachment surfaces. Shown on the exterior of sidewall 18 are two pivoting "L" shaped arms 30, and each arm 30 has one pin 30A and a handle 30B directed outwardly (Sidewall 20 is similarly equipped). Each corner webbing thus has an associated pivoting arm 30 and connecting pin 30A. Each arm is restricted or "stopped" to allow rotation in only one direction. The restriction can be provided by blocking 30C attached to the sidewall or by placement of the arm near an obstruction, such as a vertical rib, as is shown in FIG. 13. The webbing slot and associated pin is suitably located such that when webbing is threaded through the slot and looped over the pin, the bag is supported by the webbing as a pull on the webbing causes rotation of the pivoting arm into the stop or restriction (see FIG. 13 showing this relationship for a front corner webbing).

Operation of the Compactor

In operation, a bag is inserted into the interior of the compactor compartment and the four webbing loops are threaded through the associated slot to be looped over the associated pin on the pivoting arm. Materials are loaded into the compactor compartment through the screened access door. The screened access door is closed, and the ram positioned in the center of the compactor compartment by suitable motion of the hydraulic frame. The ramming plate descends, operated by the hydraulic cylinder/piston, compacting the materials, and then is retracted upon completion. This sequence is repeated until the bag is full or the compartment is to be emptied.

To remove the bag, the access doors are opened and the webbing is released from the pins on the adjacent sidewalls. To release the webbing from the pins, the handle is used to rotate the pivoting arm (a slight upward movement of the arm may be required). The released webbing is then threaded back through the wall slots. A crane or similar lifting device is then attached to the webbing, and the bag lifted from the interior. It is preferred that the bag be provided with flaps to close the bag. If a single flap is provided as an extension of the bag's sidewall, four openings in the bag's sidewall should be provided to allow the straps to be threaded through the flap for attachment to the sidewalls of the frame.

Operation of the Bailer

In operation, cardboard or boxes are placed in the interior of the container. Generally, only the top access door is opened to allow materials to be placed in the interior. When the container is about ½ "full," the top access door is closed, the hydraulic ram is moved into position in the center of the bailer compartment (by movement of the hydraulic frame), and the hydraulic cylinder is activated allowing the piston to extend and the ramming plate to crush/compresses the materials in the interior of the bailer chamber. The piston is then retracted to its resting position immediately below the hydraulic frame. By compressing the materials, additional room is provided for disposal of more cardboard materials, either at this time or later.

This sequence is repeated until the compressed materials fill approximately the lower ½ of the interior of the bailer, indicating the bailer is "full" and ready for emptying. When ready for emptying, the materials are again compressed, but the hydraulic piston is not retracted. The front doors are opened, providing access to the compressed materials. Bailing wire, bailing tape or other wrapping material is threaded through the slots on the bottom floor to the back of the compartment. From the outside rear of the device, the wire is redirected (using the aligned wall slots) up the side of the compressed materials, and back across the top of the compressed materials through the aligned slots on the ramming plate. The user then returns to the front of the bailer, and attaches the two ends of the bailing wire to "wrap" the compressed materials in a compressed state. The ramming plate is then retracted. The final step is to activate the bailed material removal means to empty the bailer chamber. For instance, by activating the pumping cycle of the hydraulic device located in the floor of the bailing compartment to initiate removal of the bailed material. If the removal means includes the hydraulic cylinder and teeth, upon activation, this cylinder causes the top plate to move forward about 1 foot, pushing the bailed material forward about 1 foot (the teeth on the plate grips the materials for forward movement). The piston in the cylinder then retracts, drawing the top plate rearward about 1 foot. However, the materials are not drawn rearward by this action as the teeth are forward facing and slidable rearward without grabbing. The piston cycle is repeated several times until the compressed bailed materials are pushed out of the interior of the bailing compartment. At this time, the compressed bailed package can be moved by crane, forklift or other suitable means.

As shown, the combination bailer/compactor has interior facing guide tracks 93 upon which the hydraulic frame travels. The interior facing tracks are utilized to help eliminate pinch points. A channel or guide with is accessible from the exterior could also be utilized, such as the guide/channel shown in U.S. Pat. No. 5,746,121 to Zimmer, herein incorporated by reference, which utilizes a hydraulic cylinder to move the hydraulic frame from one position to the other.

Finally, the operational power source has been described as hydraulics. Electric motors/pumps could also be utilized.

I claim:

1. A combination bailer/compactor comprising:

(a) a structure having a series of sidewalls and a floor portion, said structure having a top portion and a bottom portion, said sidewalls forming an interior, at least one interior partition positioned between two of said series of sidewalls forming a bailer compartment and a compactor compartment, (b) a track located near said top portion of said structure;

(c) a means for compressing materials, said means being moveable with respect to said track between said bailer compartment and said compactor compartment;

(d) a power source operationally connected to said means for compressing materials and;

(e) a compactor access opening and a bailer access opening positioned on certain of said series of sidewalls, each said compactor and bailer access opening positioned for accessing the interior of the respective compartments, and said compactor access opening having an associated compactor door and said bailer access opening having an associated bailer door, said compacter access opening and said bailer access opening being located on adjacent sidewalls of said series of sidewalls.

2. The combination bailer/compactor of claim 1 where said bailer compartment further includes a means to remove bailed materials.

3. The combination bailer/compactor of claim 1 where said structure further includes a means to resist sidewall bow out.

4. The combination bailer/compactor of claim 3 wherein said means to resist sidewall bow out includes said track, said track including two guide channels, each having an upstanding lip, said guide channels being on opposing sidewalls.

5. The combination bailer/compactor of claim 4 further having a hydraulic frame, said means for compressing materials being mounted on said hydraulic frame, said hydraulic frame being moveable on said track.

6. The combination bailer/compactor of claim 5 wherein said hydraulic frame includes a plurality of rollers, said rollers riding on said upstanding lips of said guide channels.

7. The combination bailer/compactor of claim 1 wherein said means for compressing materials includes a ramming plate, said ramming plate having a face directed into said interior of said structure, said face having a series of face slots thereon.

8. The combination bailer/compactor of claim 7 wherein said floor portion in said bailer compartment has a series of raised non-abutting panels creating a series of panel slots therebetween and said sidewall of said bailer compartment opposite said bailer access door includes a series of non-abutting vertically oriented slats creating a series of slat slots therebetween.

9. The combination bailer/compactor of claim 1 further having a bag, said bag being partially positioned in said compacter compartment and adapted to partially line said compacter chamber.

10. The compactor bailer of claim 1 wherein said interior of said bailer compartment is tapered.

11. The compactor/bailer of claim 1 wherein said structure is adapted to be disassembled.

12. The compactor/bailer of claim 11 where said adaptation includes said floor portion being removably attachable to said sidewalls, and where each of said sidewalls is removably attachable to two other of said sidewalls.

13. The compactor/bailer of claim 1 wherein said track includes two guide channels, each said guide channel position near said top portion of said structure and running substantially parallel to one of said side walls, and where said compactor access door is located on one of said sidewalls that is not substantially parallel to said guide channels.

* * * * *